US006165687A

United States Patent [19]

Reele

[11] Patent Number: 6,165,687

[45] Date of Patent: Dec. 26, 2000

[54] STANDARD ARRAY, PROGRAMMABLE IMAGE FORMING PROCESS

[75] Inventor: Samuel Reele, Rochester, N.Y.

[73] Assignee: Eastman Kodak Company, Rochester, N.Y.

[21] Appl. No.: 09/342,390

[22] Filed: Jun. 29, 1999

[51] Int. Cl.[7] ..... G03C 5/00

[52] U.S. Cl. ..... 430/293; 430/292; 430/294; 430/346; 430/945; 503/201

[58] Field of Search ..... 430/292, 293, 430/294, 346, 945; 347/232, 262, 264; 503/201, 227

[56] References Cited

U.S. PATENT DOCUMENTS

| | | | |
|---|---|---|---|
| 4,774,529 | 9/1988 | Paranjpe et al. . | |
| 4,946,297 | 8/1990 | Koike et al. . | |
| 5,000,595 | 3/1991 | Koike et al. . | |
| 5,009,531 | 4/1991 | Koike . | |
| 5,196,864 | 3/1993 | Caine . | |
| 5,364,829 | 11/1994 | Kishimoto et al. | 503/201 |
| 5,540,477 | 7/1996 | Mori . | |
| 5,616,416 | 4/1997 | Yamaguchi | 428/411.1 |
| 5,853,255 | 12/1998 | Soshi et al. . | |

FOREIGN PATENT DOCUMENTS

| | | |
|---|---|---|
| 0 645 251 A1 | 3/1995 | European Pat. Off. . |
| 0 785 083 A1 | 7/1997 | European Pat. Off. . |
| 7-214870 | 8/1995 | Japan . |
| 8-72282 | 3/1996 | Japan . |
| 8-99453 | 4/1996 | Japan . |
| 8-184410 | 7/1996 | Japan . |
| 9-314871 | 12/1997 | Japan . |
| 95/24316 | 9/1995 | WIPO . |

*Primary Examiner*—John A. McPherson
*Attorney, Agent, or Firm*—Walter S. Stevens

[57] ABSTRACT

Standard array, programmable image forming process. The process includes the steps of providing or forming a standardized array of pixel sites (16) on a surface of a substrate (12), each pixel site (16) including at least one color element (18, 20, 22) or colored sub-pixel at a predetermined location on the substrate (12), and providing or forming an opaque layer (24) over the pixel sites (16) obscuring the color elements (18,20,22) or sub-pixels thereof, the opaque layer (24) being changeable for rendering selected of the color elements (18,20,22) or sub-pixels visible for forming the image. The substrate (12) can include a paper material or a plastics film such as a transparent film, and the pixels sites (16) can be mass produced thereon by a suitable process, such as ink printing process, a thermal printing process, a laser printing process or the like. The opaque layer (24) can be any suitable organic or inorganic material operable for obscuring the pixel sites (16), the opaque layer (24) being capable of selective removal or ablation for rendering the selected color elements (18, 20, 22) visible.

36 Claims, 3 Drawing Sheets

STANDARD ARRAY, PROGRAMMABLE IMAGE FORMING PROCESS

BACKGROUND OF THE INVENTION

This invention generally relates to a process for forming a visible image on a substrate such as paper, film, transparency, or the like, and more particularly to a process wherein the image is formed on a virgin hard copy output media consisting of a standardized array of pixel sites each composed of at least one color element or colored sub pixel covered by an opaque layer, the image being formed by changing predetermined portions of the opaque layer to render or make selected portions of the underlying color elements or sub pixels visible.

Currently, the known hard copy output printers are designed around three technologies: (1) thermal, (2) inkjet, and (3) LED/laser technology. Like zero-graphic copy machines, the basis of the printing process is to start with a blank or white sheet of virgin hard copy output material. Each technology then uses an additive process to generate the desired output color at the appropriate pixel site on the output material by essentially adding or replicating the process a multiple number of times for each pixel site. For color copies, each desired color at each pixel site is typically the result of multiple "prints" at each pixel site. Although sometimes a discrete color is formed as in the inkjet process and therefore color addition is once with respect to inkjet printing, more often printing must occur more times to generate the required final pixel color from the primary inkjet colors. With respect to thermal printing, the printing process at each pixel site is a successive additive process (color subtractive for up to three to four colors). As a result, the entire process is time consuming since the printer needs to change donor material for each color printed for the thermal process or requires a repetitive printing at each pixel site for LED/laser or inkjet processes. Due to the creative pixel nature, all printed pixels are uniquely formed and therefore the quality of each pixel must be controlled with resulting overall quality being the result of the worst case pixel. This is especially true on photographic prints, since the eye is an excellent Fourier transform and picks up small artifacts in an easy manner. As a result, the known printing processes require a complex and therefore costly end user printer. In addition, as higher and higher densities are desired, the time to print and the cost/complexity of the end user printer increases substantially.

Therefore, there is a need to provide a new image forming or printing process which reduces cycle time and increases resolution, yet which allows for a lower cost, less accurate but more robust end use printer or image forming device in which the quality of each pixel printed or formed is virtually identical.

SUMMARY OF THE INVENTION

An object of the present invention is to provide an image forming process which reduces cycle time, increases resolution, and allows for use of a lower cost, but more robust end use printer in which the quality of each pixel formed or printed is virtually identical.

With this object in view, the present invention resides in a method for preparing a substrate surface for forming an image thereon, comprising the steps of providing or forming a standardized array of pixel sites on the surface, each pixel site including at least one color element or colored sub pixel at a predetermined location on the surface, and providing or forming an opaque layer over the pixel sites obscuring the color elements or sub pixels thereof, the opaque layer being changeable for rendering selected color elements or sub pixels visible for forming the image.

According to an exemplary embodiment of the present invention, the substrate can comprise a paper material or a plastics film such as a transparent film, or the like.

According to another exemplary embodiment of the invention, the pixel sites can include color elements of yellow, magenta, cyan, black, and/or any other desired color.

According to another exemplary embodiment of the invention, the pixel sites can be formed by an ink printing process, such as an ink jet printing process.

According to another exemplary embodiment of the invention, the pixel sites can be formed using a thermal printing process.

According to another exemplary embodiment of the invention, the pixel sites can be formed using a laser printing process.

According to still another exemplary embodiment of the invention, the opaque layer can be any suitable organic or inorganic material operable for satisfactorily obscuring the pixel sites, such as a thin film of a dark polyamide or polyimide, a metal substance comprising gold, aluminum or the like, which opaque layer is capable of being selectively removed or ablated for rendering the selected color elements visible.

And, according to a further exemplary embodiment of the invention, the opaque layer can comprise a material such as doped germanium tellurium or the like that can be selectively made light transmissive, for instance, by an optical phase change to enable viewing the selected color elements.

A feature of the present invention is the provision of a standardized array of the pixel sites at predetermined locations on the substrate such that predetermined portions of the overlaying opaque layer can be ablated, made light transmissive or transparent, or otherwise changed to make visible the underlying color elements or colored sub-pixels, which together form a desired visual image.

To enhance the image, the field around each pixel site and unchanged or non-activated color elements should be opaque. This can be achieved by making those areas black so as to be substantially light absorbing, or white, so as to be substantially reflective. Presently, the preferred substrate should include from between about 300 to about 500 pixels sites per inch.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
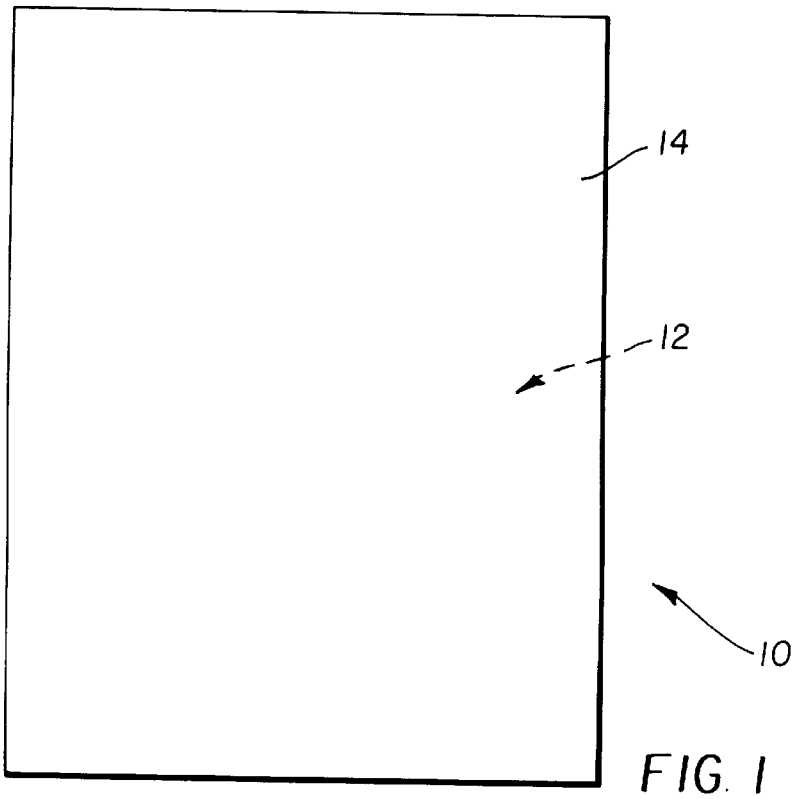
FIG. 1 is a top view of a substrate including a virgin hard copy output media belonging to the present invention.
Figure 2:
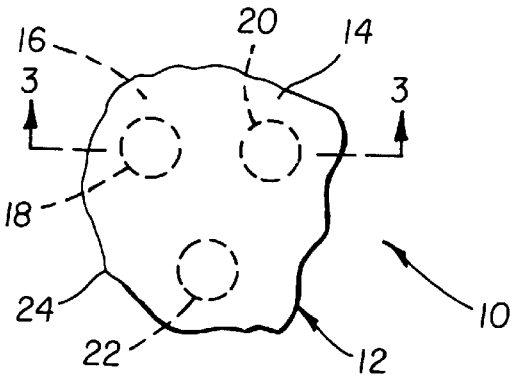
FIG. 2 is an enlarged fragmentary top view of the virgin hard copy output media of FIG. 1 showing an exemplary pixel site thereof through a covering opaque layer.
Figure 3:
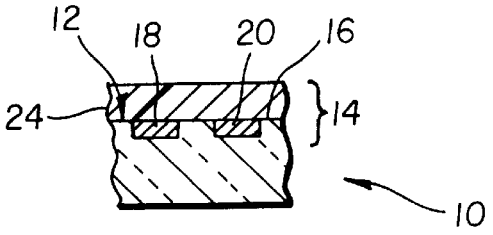
FIG. 3 is a cross-sectional view taken along line 3—3 of FIG. 2.
Figure 4:
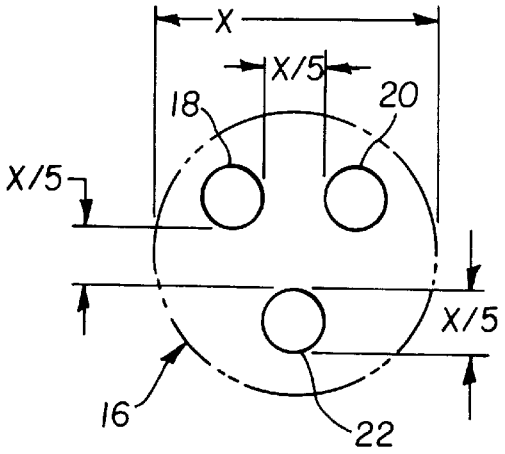
FIG. 4 is a top view of the exemplary pixel site of FIG. 2, showing the covering opaque layer removed and the pixel site proportionally dimensioned.
Figure 6:
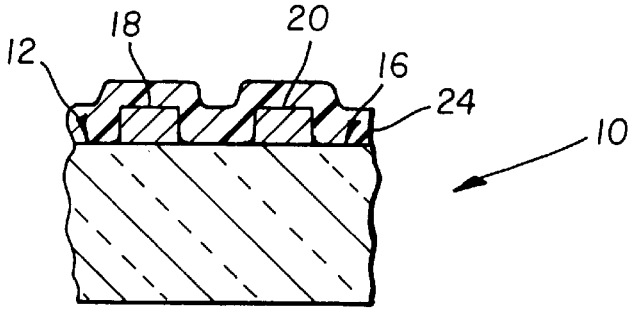
FIG. 6 is a cross-sectional view of the virgin hard copy output media of FIG. 1 including an alternative pixel site embodiment belonging to the present invention.

Therefore, referring to FIG. 1, there is shown a virgin hard copy output media 10 composed of a substrate 12 of suitable material such as a paper sheet, such as a photographic quality paper base, or a film of a thermoplastic material such as a transparent polyethylene film or the like, which substrate 12 includes a printable media layer 14 according to the present invention. Referring also to FIGS. 2 and 3, printable media layer 14 includes a standardized array of pixel sites 16 at regular intervals on substrate 12, each pixel site 16 including three angularly related color elements 18, 20 and 22 at predetermined locations on substrate 12. In the preferred embodiment, pixels sites 16 cover essentially all of a top surface of substrate 12 and are arrayed in columns and rows each containing from about 300 to about 500 pixel sites 16 per inch. Color elements 18, 20 and 22 of each pixel site 16 are of different colors, elements 18 preferably being cyan, color elements 20 preferably being magenta, and color elements 22 preferably being yellow. Here, it should be understood that it is contemplated that alternative colors and combinations of colors can also be used, as desired. Color elements 18, 20 and 22 can be formed in or on substrate 12 using any suitable conventional printing process, such as a laser process wherein colored ink or dye is deposited into substrate 12, as shown in FIG. 3, or wherein the ink or dye is deposited on the surface of substrate 12, such as by an ink jet printing method or thermal transfer method, as illustrated in FIG. 6. Color elements 18, 20 and 22 as shown in FIG. 3 can have a depth as measured into substrate 12 of from about 1/10 of the width of the respective color element to about equal to the width thereof. The preferred shape for the color elements 18, 20 and 22 is round, as shown, although other shapes can likewise be used. Referring to FIG. 4, elements 18, 20 and 22 each have a diametrical dimension equal to about 1/5 the diametrical dimension of pixel site 16 denoted by the letter "x" and the elements 18, 20 and 22 are spaced apart by about the same distance as their respective diameters.

Referring more particularly to FIGS. 2 and 3, printable media layer 14 including pixel sites 16 is covered by an opaque layer 24 to obscure color elements 18, 20 and 22 of the pixel sites. Opaque layer 24 can be composed of any substantially non-light transmissive material suitable for selective ablation or removal, such as, but not limited to, organic materials such as a dark polyamide or polyimide, or inorganic materials such as a thin coating of deposited metallic material such as derived from gold or aluminum. Alternatively, opaque layer 24 can be composed of a non-light transmissive material which can be selectively rendered light transmissive using an optical phase change process, such as, but not limited to, germanium tellurium with various other dopants, or materials that are subject to an optical phase change when exposed to a momentary burst of energy, such as a voltage. Opaque layer 24 must be opaque, but may be black so as to substantially totally absorb light, or white, so as to substantially totally reflect light, to provide desired contrast for forming the image, the portion of the opaque layer to be changed, that is, ablated, or otherwise removed, or subject to the optical phase change, to allow light transmission, will be limited for best result.

Figure 5:
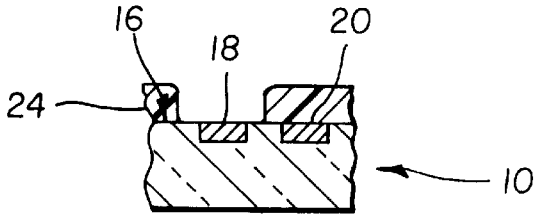
FIG. 5 is another cross-sectional view taken along line 3—3 of FIG. 2, showing a predetermined portion of the covering opaque layer removed to expose a color element of the pixel site.

Referring to FIG. 5, the rendering of color element 18 of a pixel site 16 of output media 10 to a visible state by removal of opaque layer 24 thereover is shown. Note here that the removal of opaque layer 24 is sufficiently selective such that color element 20 remains covered and obscured by opaque layer 24.

FIG. 6 shows color elements 18 and 20 of pixel site 16 formed on the top surface of substrate 12 as a consequence of using a conventional ink or dye deposition process, such as an ink jet printing process. The color elements will have the same general dimensions as explained above, with the exception that the color elements are located above the top surface of substrate 12, not therein as with the previous embodiment. The same opaque layer 24 is used to obscure the color elements, here opaque layer 24 conforming to the shape of the color elements. Alternatively, opaque layer 24 could be sufficiently thick to have a flat top surface.

Additionally, opaque layer 24 can be changed, that is, ablated or otherwise removed, or subjected to an optical phase change so as to become suitably light transmissive or transparent, at predetermined locations corresponding to selected color elements 18, 20 and 22 in the same manner regardless of whether the color elements are formed in surface 12 of substrate 10 using a thermal printing process or the like, or deposited on surface 12 using an ink jet printing process, laser printing process, or the like.

Figure 7:
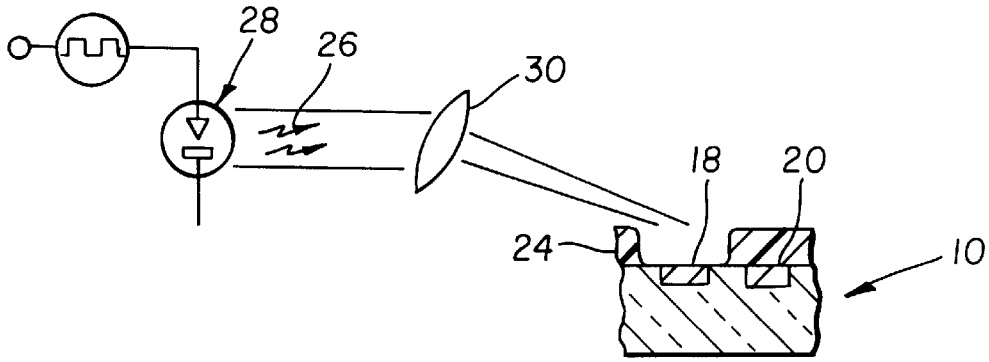
FIG. 7 is a cross-sectional view taken along line 3—3 of FIG. 2, showing a predetermined portion of the covering opaque layer removed to expose a color element of the pixel site, and illustrating in schematic form, apparatus for removing the opaque layer portion.

Turning to FIG. 7, ablation of a predetermined portion of opaque layer 24 over color element 18 to render element 18 visible is illustrated. Here, radiant energy 26, illustrated so as to represent either columnized light such as laser light having a wave length of, for example, from about 400 nanometers (nm) to about 850 nm, or uncolumnized light of about the same wave length range, preferably is emitted from a radiant energy source 28 such as a laser diode or LED, and can be focused through a lens 30 at a predetermined portion of opaque layer 24 overlaying the selected color element 18 or otherwise employed so as to ablate the predetermined portion of the opaque layer 24 thereby rendering color element 18 visible.

Figure 8:
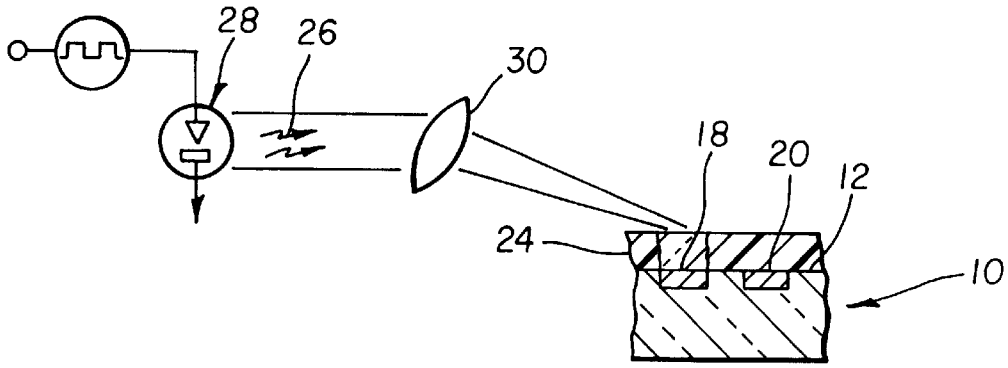
FIG. 8 is a cross-sectional view taken along line 3—3 of FIG. 2, showing a predetermined portion of the covering opaque layer removed to expose a color element of the pixel site, and illustrating in schematic form, apparatus for causing an optical phase change in the opaque layer for exposing the color element.

FIG. 8 shows the radiant energy 26, which again represent columnized or non-columnized light, emitted from radiant energy source 28 or plasma passing, if needed through lens 30 at the predetermined portion of opaque layer 24 over color element 18 or otherwise employed to cause the predetermined portion of the opaque layer to undergo in some cases an optical phase change, and in other cases a physical phase change so as to be rendered light transmissive (or transparent or soluble in alkali solution by photolithographic processing) to thereby render color element 18 visible (or exposed to ambient conditions).

Here, it should be understood that, since color elements 18, 20 and 22 of each pixel site 16 are spaced relatively far apart, the portion of opaque layer 24 ablated or otherwise removed, or subject to optical or physical phase change, can be relatively large, thus enabling some inaccuracy in the focusing of radiant energy 26 without visible distortion of the image being formed. For instance, as long as the adjacent color element is not unintentionally uncovered, the portion of opaque layer 24 subject to removal or phase change can be as large as the color element itself and up to twice the space around the color element, since an uncolored area equal to the diameter of the color element is present therearound as shown.

To illustrate an important advantage of the present invention, color elements (also known as sub-pixels) 18, 20 and 22 of pixel sites 16 can be very precisely mass produced on the surface of the selected substrate 12 using any suitable conventional printing method such as a thermal or ink jet process. A software program, such as a conventional color digital signal processing map program can then be used to position the radiant energy source 28 and lens 30 for ablating or causing optical phase change of the predetermined portions of the opaque layer 24 overlaying the selected sub-pixels or color elements less accurately, but with an accurate image still being formed. This enables the end user printer device, namely the processor for operating the software program, the radiant energy source and apparatus for directing the emitted radiant energy to be relatively inexpensive. Thus, it is illustrated that using the output copy media of the present invention and a relatively inexpensive device for changing the opaque layer thereof as described hereinabove, very high quality images can be produced.

The mechanical arrangement described above is but one example. Many different configurations are possible.

Therefore, what is provided is a standard array, programmable image forming process for relatively inexpensively making high quality, accurate images.

PARTS LIST

10 . . . hard copy output media
12 . . . substrate
14 . . . printable media layer
16 . . . pixel site
18 . . . color element
20 . . . color element
22 . . . color element
24 . . . opaque layer
26 . . . radiant energy
28 . . . radiant energy source
30 . . . lens

What is claimed is:

1. A method for preparing a substrate surface for forming an image thereon, comprising the steps of:

(a) providing an array of multiple pixel sites on the surface, each pixel site including at least one color element at a predetermined location on the surface; and (b) providing an opaque layer over the pixel sites obscuring the color elements thereof, the opaque layer being changeable for rendering selected color elements of selected pixels visible to form the image.

2. The method of claim 1, wherein the pixel sites are formed by an ink printing process.

3. The method of claim 2, wherein the ink printing process is an ink jet printing process.

4. The method of claim 1, wherein the pixel sites are formed using a thermal printing process.

5. The method of claim 4, wherein the thermal printing process is a laser printing process.

6. The method of claim 4, wherein the thermal printing process utilizes at least one light emitting diode for forming the pixel sites.

7. The method of claim 1, wherein each of the pixel sites includes a cyan color element and a magenta color element.

8. The method of claim 7, wherein each of the pixel sites further includes a yellow color element.

9. The method of claim 1, comprising the further step of:

(c) changing predetermined portions of the opaque layer to render the selected color elements visible.

10. The method of claim 9, wherein the selected of the color elements are rendered visible by ablating the predetermined portions of the opaque layer.

11. The method of claim 10, wherein the predetermined portions of the opaque layer are ablated using a thermal process.

12. The method of claim 11, wherein the thermal process utilizes laser light for ablating the predetermined portions of the opaque layer.

13. The method of claim 9, wherein the selected color elements are rendered visible by causing an optical phase change in the predetermined portions of the opaque layer.

14. The method of claim 13, wherein the optical phase change is caused by a thermal process.

15. The method of claim 13, wherein the optical phase change is caused by a laser light.

16. The method of claim 13, wherein the optical phase change is caused by a non-columnized light.

17. The method of claim 9, wherein the selected color elements are rendered visible by photolithographic processing to dissolve the predetermined portion of the opaque layer in alkali developer solution.

18. The method of claim 17, wherein the substrate comprises from about 300 to about 500 of the pixel sites per inch of the surface.

19. A method for forming an image, comprising the steps of:

(a) providing a substrate having a surface containing a standardized array of pixel sites each including at least one colored sub pixel at a predetermined location thereon, the pixel sites underlying an optically opaque layer obscuring the at least one sub pixel;

(b) providing apparatus for changing portions of the optically opaque layer for rendering selected of the underlying at least one sub pixel visible to a desired extent; and (c) changing selected portions of the optically opaque layer to selectively render the underlying at least one sub pixel visible to the desired extent to form the image on the substrate surface.

20. The method of claim 19, wherein the at least one sub pixel is formed on the substrate surface by an ink printing process.

21. The method of claim 20, wherein the ink printing process is an ink jet printing process.

22. The method of claim 19, wherein the at least one sub pixel is formed on the substrate surface by a thermal printing process.

23. The method of claim 22, wherein the thermal printing process is a laser printing process.

24. The method of claim 22, wherein the thermal printing process utilizes non-columnized light for forming the at least one sub pixel.

25. The method of claim 25, wherein the apparatus is operable for changing the portions of the opaque layer by an ablation process.

26. The method of claim 25, wherein the ablation process uses laser light.

27. The method of claim 25, wherein the ablation process is a thermal ablation process.

28. The method of claim 19, wherein the apparatus is operable for changing the portions of the opaque layer using an optical phase change process.

29. The method of claim 28, wherein the optical phase change process utilizes columnized light.

30. The method of claim 28, wherein the optical phase change process utilizes non-columnized light.

31. The method of claim 19, wherein the opaque layer comprises a polyimide.

32. The method of claim 19, wherein the opaque layer comprises a metal.

33. The method of claim 32, wherein the metal is selected from the group consisting of gold and aluminum.

34. The method of claim 19, wherein the opaque layer comprises a material which will undergo an optical phase change when exposed to a momentary voltage.

35. The method of claim 19, wherein the opaque layer comprises germanium tellurium.

36. The method of claim 19, wherein the substrate comprises a material selected from the group consisting of paper and plastics film.

* * * * *

UNITED STATES PATENT AND TRADEMARK OFFICE

CERTIFICATE OF CORRECTION

PATENT NO. : 6,165,687
DATED : December 26, 2000
INVENTOR(S) : Samuel Reele

It is certified that error appears in the above-identified patent and that said Letters Patent is hereby corrected as shown below:

Column7, claim 25,
Line 4, delete "claim 25", insert -- claim 19 --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*